US005572035A

United States Patent [19]

Franzen

[11] Patent Number: 5,572,035

[45] Date of Patent: Nov. 5, 1996

[54] METHOD AND DEVICE FOR THE REFLECTION OF CHARGED PARTICLES ON SURFACES

[75] Inventor: Jochen Franzen, Bremen, Germany

[73] Assignee: Bruker-Franzen Analytik GmbH, Bremen, Germany

[21] Appl. No.: 565,107

[22] Filed: Nov. 30, 1995

[30] Foreign Application Priority Data

Jun. 30, 1995 [DE] Germany ..... 195 23 859.1

[51] Int. Cl.[6] ..... H01J 49/42; H01J 3/16

[52] U.S. Cl. ..... 250/396 R; 250/292

[58] Field of Search ..... 250/396 R, 292, 250/293, 290

[56] References Cited

U.S. PATENT DOCUMENTS

| | | | |
|---|---|---|---|
| 2,769,910 | 11/1956 | Elings | 250/292 |
| 4,568,833 | 1/1986 | Roelofs | 250/396 R |
| 4,866,279 | 9/1989 | Schelten et al. | 250/396 R |
| 5,464,985 | 11/1995 | Cornish et al. | 250/396 R |

*Primary Examiner*—Jack I. Berman

[57] ABSTRACT

The invention relates to methods and devices for the reflection of positively and negatively charged particles of moderate kinetic energies at surfaces of any form. The invention consists in the production of a virtual or real surface for reflecting charged particles by creation of strongly inhomogenous high frequency fields of low penetration range into the space above the surface. The inhomogenous electric field is produced by supply of a high frequency voltage to a narrow grid pattern forming the surface and consisting of electrically conducting electrodes, isolated from each other. The electrode elements of the pattern are regularly repeated in at least one direction within the surface. The phases of the high frequency voltage are connected alternately to subsequent grid elements. The invention can be used to build new types of ion storage devices and ion guides for the transport of ions in moderate and high vacuum. New types of mass filters can be produced by this invention. In contrast to the well-known RF multipole rod systems, the invention leads to systems with easy production, high mechanical stability, and high efficiency for the thermalization of fast ions.

42 Claims, 6 Drawing Sheets

METHOD AND DEVICE FOR THE REFLECTION OF CHARGED PARTICLES ON SURFACES

BACKGROUND OF THE INVENTION

The storage or guidance of ions in volumes of any form defined by real or virtual walls requires reflection of the ions at or near the walls without the ions being discharged. For example, mechanical enclosure is ineffective because the ions are discharged at the physical walls. Up until now, ion-conserving reflections have been limited to two-dimensional and three-dimensional radio frequency (RF) multipole fields. These are more general forms (with more poles) of the two-dimensional and three-dimensional RF quadrupole fields invented by Wolfgang Paul and Helmut Steinwedel. Multipole rod systems have been used for several years for the guidance of ions in bad or moderate vacuums where collisions with a residual gas damp the movement of the ions.

In multipole rod systems, two-dimensional multipole fields are spanned between at least two pairs of rods, arranged evenly on the surface of a cylinder parallel to its axis. The two phases of an RF voltage are fed to the rods, opposite polarities existing between neighboring rods. Two pairs of rods span a quadrupole field, increasing numbers of rod pairs span hexapole, octopole, decapole, and dodecapole fields. The fields are called two-dimensional because any cross-section perpendicular to the axis exhibits the same field distribution; there is no dependence of the field distribution on the relative location along the axis of the device.

Three-dimensional multipole fields form the class of RF multipole ion traps. They consist of at least one ring electrode (the number of ring electrodes depending on the type of trap) and exactly two end cap electrodes. One ring electrode and the obligatory end cap electrodes span a quadrupole ion trap, two rings plus end caps form a hexapole, three rings produce an octopole, and four rings a decapole ion trap.

Radio frequency multipole rod systems are frequently used either as mass filters for inexpensive mass spectrometers, or as ion guides for transporting ions between ion production and ion consumption devices, particularly in feeding mass spectrometers of any type. Radio frequency multipole rod systems are favorably suited as ion guides for ion trap mass spectrometers, such as RF quadrupole ion traps or ion cyclotron resonance (ICR) mass spectrometers. Ion trap mass spectrometers operate cyclically with ion filling phases and ion investigation phases, and ions must not be introduced during the investigation phases. Ions can be temporarily stored in such ion guides by reflecting end potentials (as described in U.S. Pat. No. 5,179,278). Temporary storage of ions produced during the ion investigation phase therefore allows an increase in the duty cycle of the ion source. Furthermore, such ion guides can be used to thermalize ions produced outside the vacuum system of a mass spectrometer, and accelerated by the process of introducing them into the vacuum system. Thermalization requires a collision gas, and the residual gas inside a differential pumping stage can easily be utilized as such (see, e.g., U.S. Pat. No. 4,963,736).

Multipole rod systems for the guidance of ions usually have small diameters to concentrate the ions in a narrow area around the axis. The narrow area forms a pointed virtual ion source for excellent optical focusing of the ions exiting the ion guide. The inner, open diameters of these rod systems amount frequently to 3 to 6 millimeters only, the rods are usually less than 1 millimeter in diameter, and the system is about 5 to 15 centimeters long. The rods are mounted to notches in ceramic rings. There are high requirements to the precision of the arrangement. The system is hard to produce and sensitive to vibrations and shock. The rods get bent very easily, and cannot be re-adjusted with the required precision.

It is the objective of this invention to create methods and devices for the reflection of charged particles at or above surfaces. It is further the object of the invention to enclose charged particles in arbitrarily formed volumes with or without openings, and to transport ions without losses. The invention should be suited to form narrow, long ion guides with a mechanically robust structure, having good aptitude for thermalization and temporary storage of ions. It should be possible to produce inexpensive mass filters by this invention.

SUMMARY OF THE INVENTION

It is the basic idea of the invention to create strong but inhomogeneous RF fields of short space penetration for the reflection of charged particles of both polarities at arbitrarily formed surfaces.

An RF field around the tip of a wire drops in field strength proportional to $1/r^2$, the RF field of a long, thin wire drops with $1/r$, where r is the distance to the wire tip, or to the wire axis. Both fields reflect positively or negatively charged particles. The particle oscillates in the RF field. Independent of its polarity, it encounters its largest repelling force exactly when it is located in its position nearest to the wire, which is the point of strongest field strength during the oscillation. It encounters its strongest attracting force exactly in its location farthest from the wire, i.e., in the point of lowest field strength during its oscillation. Integrated over time, a repelling force results. This integrated repelling force field often is called "pseudo force field", described by a "pseudo potential distribution". The pseudo potential is proportional to the square of the RF field strength; it drops with $1/r^4$ in case of the tip, and with $1/r^2$ in case of the long wire, but is, in addition, inversely proportional to both the particle mass m and the square $\omega^2$ of the RF frequency $\omega$.

If there are two nearly adjacent wire tips connected to the two phases of an RF voltage, both tips repel ions of any polarity. Their total effect is stronger than that of a single tip. It is well-known that the field strength of the dipole drops more quickly than $1/r^2$. In the present invention, a two-dimensional array of wire tips is provided, with neighboring tips alternately connected to different RF phases. The array of wire tips forms a surface which repels (or reflects) particles of both polarities at short distances. In a distance which is large compared to the distance between neighboring wire tips, the RF field is negligible. Reflection in this case belongs to the class of diffuse reflections, in contrast to specular (or regular) reflection.

In addition to the grid of wire tips, the present invention includes other reflective surface embodiments. In one embodiment, long parallel wires are spaced closely together. The wires are attached to two opposite phases of an alternating voltage such that every other wire has the same phase and, for each wire, the two wires adjacent to it have the opposite phase to it.

In another embodiment, a reflective surface is formed from a combination of wire tips and a wire mesh arranged around the tips. A particular form of this embodiment has the wire mesh shaped like a "honeycomb" structure, with a wire tip located in the center of each "cell" of the honeycomb.

With the present invention, it is easy to shape the surfaces into cylindrical or conical arrangements for the guidance of particles. In general, any surface of the invention can be wound to form a cylinder or a cone. For instance, a cylinder can be built with an array of metal tips, or with meshes and tips.

In one embodiment of the invention, a cylindrical guidance field is constructed from parallel wire rings, neighboring rings being connected to different phases of the RF voltage. This structure corresponds to a surface with parallel wires which is wound up in the direction of the wires. This arrangement of parallel wire rings may also be regarded as a linear series of quadrupole ion traps with open end cap electrodes. Within the center of each ring, there exists a small quadrupole ion trap, each with a small pseudo potential well. When these wells are too shallow, ions can get trapped within the structure. In an alternative embodiment, however, a DC field is superimposed along the axis of this cylindrical arrangement, thus helping the ions through the ion guide in spite of the pseudo potential wells.

In a notable embodiment of the invention, a suitable piece of the parallel wire surface is wound up to form a cylinder wall with helical wire structure. Preferably, an entire cylindrical grid structure with multiple grid elements in an axial direction is produced from only two wires wound helically around a cylindrical core at about equal distances. The two wires of this "double helix" are connected to the two RF voltage phases.

As with the ring structure, the double helix is well-suited to thermalizing the ion's kinetic energy. By supplying a small DC current through both wires, a weak DC field along the axis may be superimposed, driving the ions through the device. The current may be kept extremely small if wires with relatively high resistance are used. A choke may be used to prevent the RF from flowing into the DC power supply. In this embodiment, the drive of the ions can be switched on and off by switching the DC current. Similar to the double helix, "fourfold helices" and "sixfold helices" may also be produced according to the present invention.

The cylindrical arrangements described, including those with metal wire tips, rings or helices, have cut-off limits for low mass-to-charge ratios of the ions to be reflected. The cut-off limit is given by the fact that a light particle below a critical mass is either accelerated to the grid element in a single half of an RF period, and is thereby eliminated by impingement, or it is reflected in a single half of an RF period, thereby taking up additional energy from the increasing RF field. In subsequent reflections, the particle is either impinging or it takes up more and more energy until it leaves the field by evasion between the wires or points. The cut-off limit for a particular structure can be determined experimentally.

By superimposing the RF voltage with a DC voltage, it is possible to create an upper mass-to-charge ratio cut-off limit. As is known from the quadrupole mass filter, each second pole gets an attracting DC potential for ions of one polarity. The attracting DC potential counteracts the repelling pseudo potential. Since the pseudo potential is inversely proportional to the mass-to-charge ratio, but the attracting force is not dependent on the mass-to-charge ratio, ions with high mass-to-charge ratios are no longer repelled, but impinge on the wire. Thus, it is possible to produce mass filters from a double helix as desired herein. Ion guides for ion traps may therefore be used advantageously for the preselection of ions within a range of mass-to-charge ratios.

Ion guides according to this invention can be cylindrical or conical, and can be used as storage devices if the end openings are barred for the exit of ions by reflecting RF or DC potentials. With RF field reflection, ions of both polarities can be stored. With DC potentials, ion guides store ions of a single polarity only. In both cases, there is the possibility to gate the exit of ions. In case of DC reflection, switchable ion lenses can be used to extract ions from the ion guide, and to focus the ions into the next stage, e.g., into an ion trap or into a second ion guide. An additional DC field along the axis of the first ion guide can diminish the time needed to empty the ion guide.

Such a temporary ion store has some advantages if used in connection with ion traps. Ion sources generally produce ions continuously, but ion traps can accept ions only during relatively short filling periods. Temporary storage thus improves the duty cycle. This is valid for all types of traps, e.g. RF quadrupole ion traps, or ion cyclotron resonance (ICR) mass spectrometers.

The effect of the inhomogenous electric fields on charged particles according to this invention depends strongly on the viscosity of the gas surrounding the charged particles and on the frequency of the electric field. The invention is particularly useful for the guidance and storage of ions in a pressure regime below $10^{-1}$ millibar, and with frequencies above 100 kilohertz. If the device is operated at audio frequencies, it may be used at normal air pressures for charged macroparticles.

Beside guidance and storage purposes, the invention may be used also to build ion gates of some extended area. Ions of both polarities, e.g. ions of a plasma, can be switched at the same time. In contrast to switches used hitherto, this new type of ion gate does not destroy ions during the closing period of the gate because the particles of both polarities are reflected.

DETAILED DESCRIPTION OF THE PREFERRED EMBODIMENTS

Figure 1:
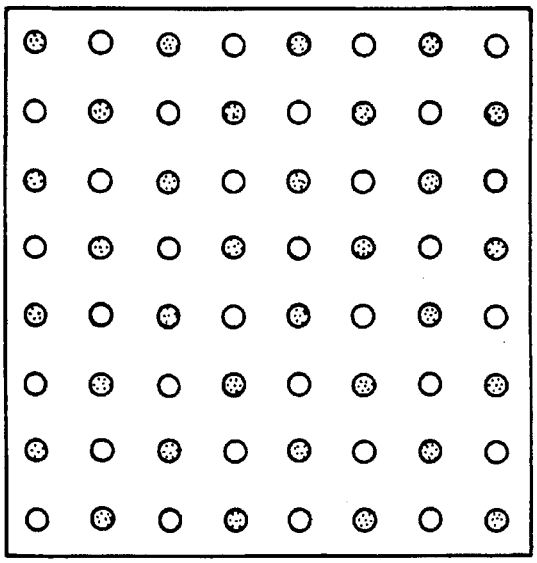
FIG. 1 is a schematic view of a surface pattern of a grid of metal wire tips according to the present invention.
Figure 2:
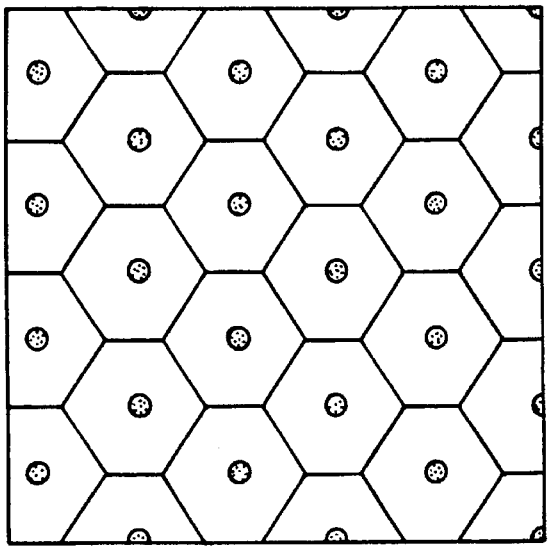
FIG. 2 is a schematic view of a surface pattern of a mesh and tip grid according to the present invention.
Figure 3:
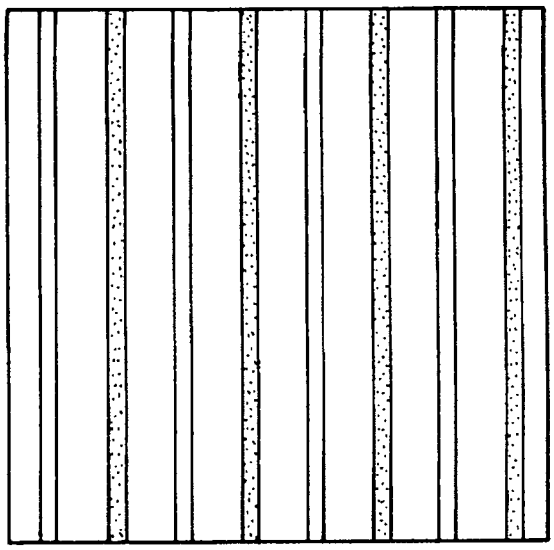
FIG. 3 is a schematic view of a surface pattern of a grid produced by parallel wires according to the present invention.

Some of the reflective surface profiles of the present invention are shown in FIGS. 1–3. FIG. 1 shows, schematically, a grid-like arrangement of wire tips, each of which is electrically connected to one of two opposite phases of an alternating voltage. The connection of the tips is alternated such that every other tip in either the horizontal or vertical direction of the grid is the same phase. This alternation of the phases is demonstrated by the shading of the tips shown in FIG. 1. All of the darkly-shaded tips have the same phase, and all of the lightly-shaded tips have the same phase.

A variation of the FIG. 1 surface profile is shown in FIG. 2. In this variation, a grid of wire tips is used with all the tips having the same phase of an RF voltage. Interlaced between the wire tips is a wire grid which, in the preferred embodiment, is "honeycomb" shaped, with each wire tip being located at the center of one of the "cells" of the honeycomb. The wire grid is connected to the opposite phase (i.e. ±180°) relative to the phase of the tips.

It is relatively hard to produce such an array of wire tips, but such an array is not necessarily needed. In another alternative embodiment of the invention (shown in FIG. 3), an array of long, parallel wires is provided for which the wires are alternately connected to the opposite phases of an RF voltage. As with the wire tips, this construction forms an ion reflector. The reflection is regular in the direction of the wire axis, and diffuse in the direction orthogonal to the wire axis. The surface produced from parallel wires forms an RF field which also has a rather short penetration into the space above the surface. The field drops almost exponentially in front of a large area of wires. With a field strength F at the surface of a single wire, having a diameter of 1/10 of the wire distance D, the field drops to 5% of F in a distance of D above the surface, to 0.2% of F in a distance 2D, and to a field strength of only 0.009% of F in a distance of 3D. The pseudo potential of this RF field, being proportional to the square of the field strength, drops even more quickly.

Figure 4:
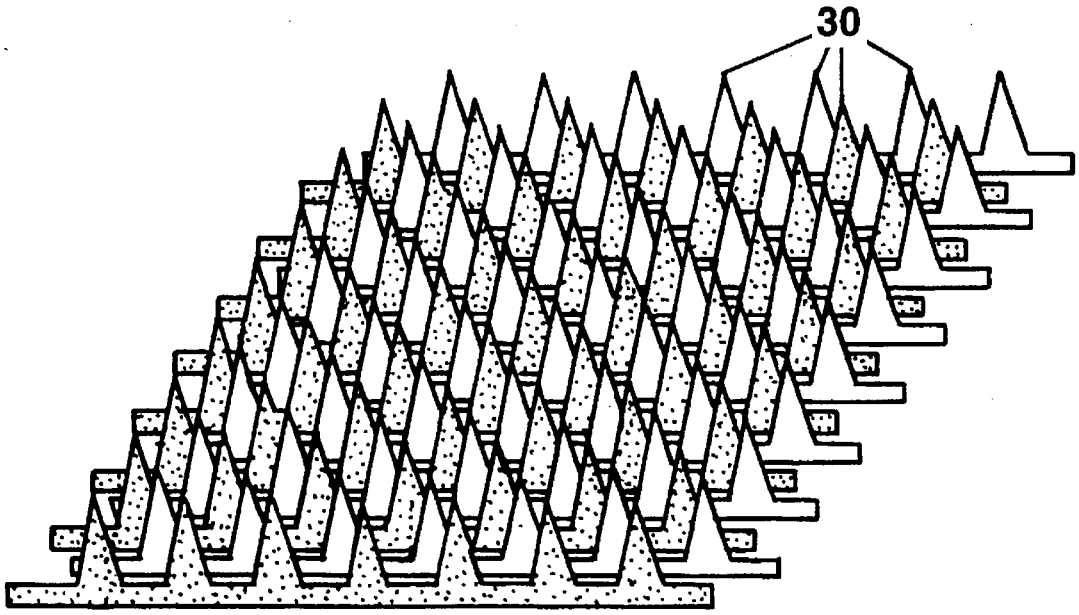
FIG. 4 is a perspective view of the grid of metal tips.

A surface (corresponding to the profile of FIG. 1) for reflecting ions of both polarities is shown in FIG. 4. This surface is formed by narrowly spaced metal tips 30. Although not to scale, the general configuration of the tips is shown in FIG. 4. In the preferred embodiment, a radius of each amounts to between 1/10 and 1/5 of the distance between adjacent tips. The tips are arranged such that each tip has an electrical potential equal to a first phase of an RF signal, and (except those at the edges) is surrounded by four tips with an electrical potential equal to a second phase which is opposite to (i.e. 180° different from) the first phase. The tip construction provides a surface with a particularly short penetration range of its RF fields into the space above the surface. The strongly inhomogeneous field in front of the tip pattern reflects charged particles of any polarity. The rounded tips help to reduce the required RF voltage for a given reflection effect, although they result in a slightly higher cut-off mass.

The short penetration range of the FIG. 4 embodiment provides several significant advantages. Many applications of this invention, however, do not require a short range of the RF fields. For ion guides, it is advantageous to have an adjustable penetration range. This allows for an adjustable pseudo potential well. In the present invention, the adjustment is performed by changing the distance of the grid elements, particularly the distance between the wires.

Figure 5:
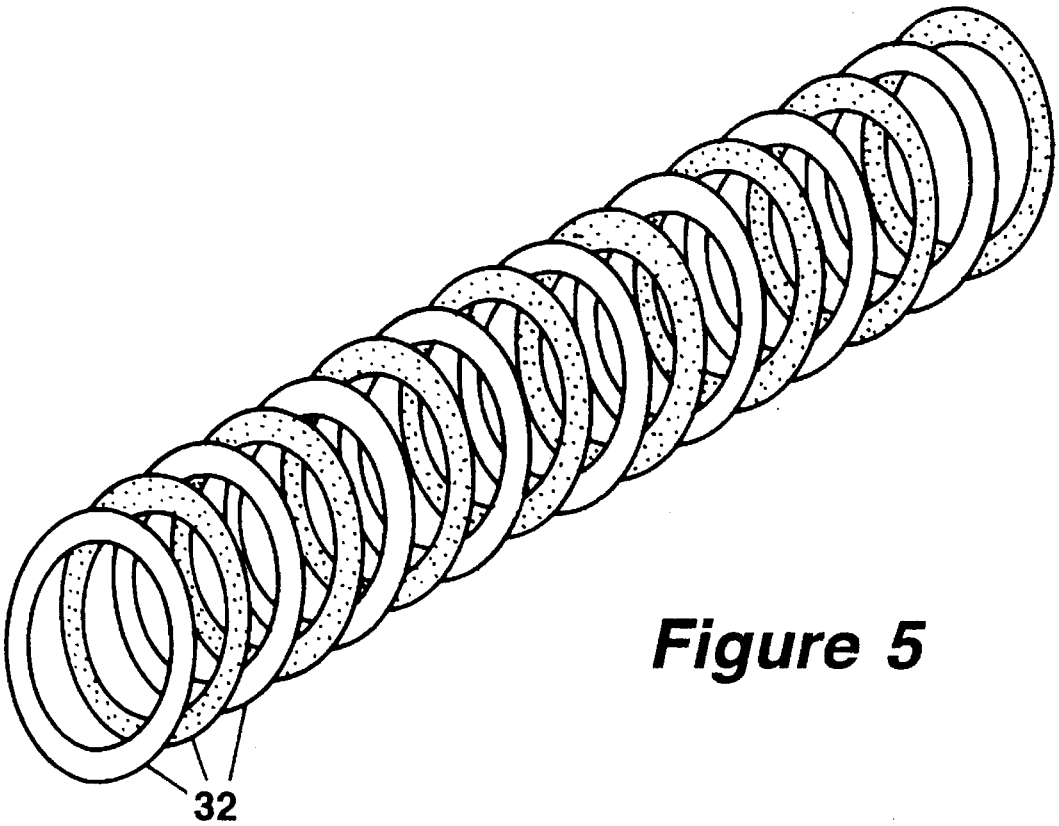
FIG. 5 is a perspective view of an ion guide made from parallel rings, alternately connected to both phases of an RF voltage.
Figure 6:
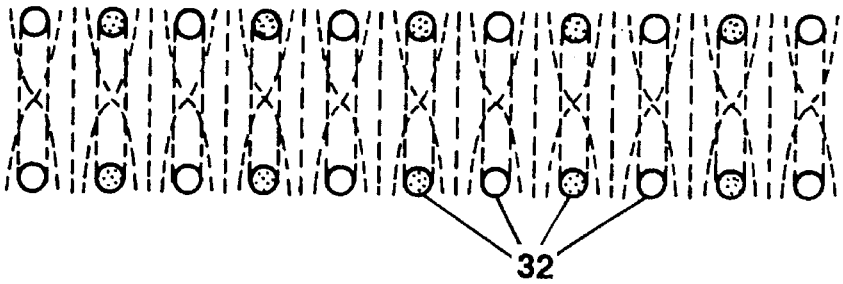
FIG. 6 is a schematic representation of the potential distribution inside the rings of FIG. 5.

One embodiment of the invention, shown in FIG. 5, comprises a series of parallel rings 32, each ring having a phase opposite that of its two neighboring rings. Along the axis, there thus exists a slightly undulating structure of the pseudo potential, slightly obstructive for a good and smooth guidance of ions. On the other hand, the diffuse reflection of particles at the cylinder wall is favorable for a fast thermalization of the ion's kinetic energy if the ions are shot about axially into the cylinder. As shown in FIG. 6, this arrangement generates, in each of the ring centers, the well-known potential distribution of ion traps with their characteristic equipotential surfaces crossing in the center with angles of $\alpha=2 \arctan (1/\sqrt{2})$. The quadropole fields, however, are restricted to very small areas around each center. In the direction of the cylinder axis, the pseudo potential wells of the centers are shallow because the traps follow each other in narrow sequence. In general, the pseudo potential wells are less deep the closer the rings are together. Emptying this type of ion guide by simply letting the ions flow out leaves some ions behind in the shallow wells.

Figure 7:
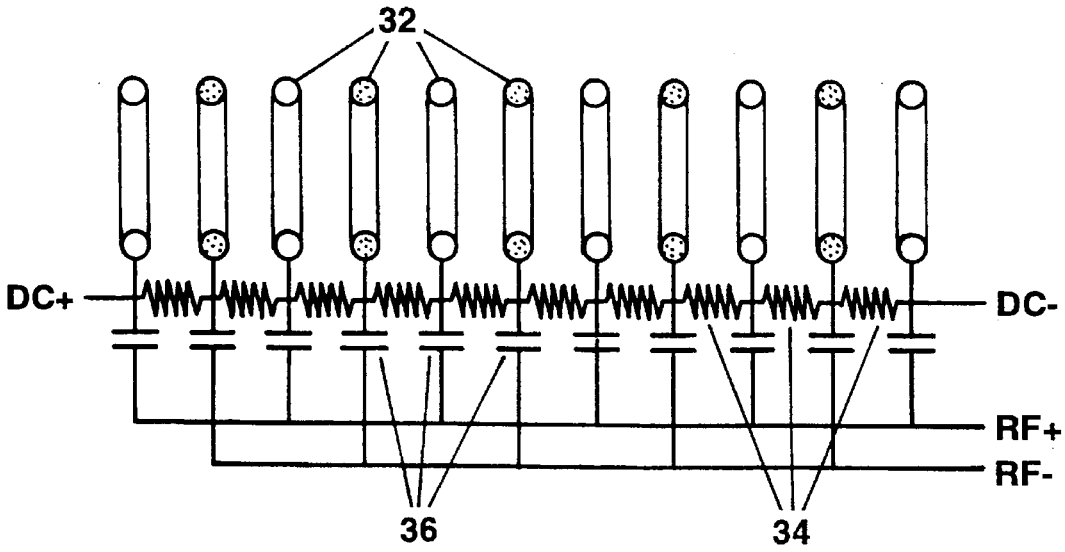
FIG. 7 is a schematic representation of the superposition of an axial DC field to drive the ions through the device.

In this embodiment, an axial DC field is used to drive the ions out, ensuring that the ion guide is completely emptied. The electric circuits needed to generate this DC field are shown in FIG. 7. The RF voltage is supplied to the ring electrodes via condensers, and the rings are connected by a series of resistance chokes forming a resistive voltage divider for the DC voltage, and hindering the RF from flowing through the voltage divider. The DC current is switchable, and the DC field helps to empty the device of any stored ions. With rings 32 of 5 millimeter in diameter, resistance chokes 34 of 10 microhenries and 100 Ohms, and capacitors 36 of 100 picofarads build up the desired DC fields. Fields of a few volts per centimeter are sufficient.

Ion guides preferably are narrow and long, with inner diameters of 3 to 8 millimeters. The length is given by the size of the differential pumping chambers, and amounts to roughly 5 to 15 centimeters. The narrow diameter of the ion guide provides a good bunching of ions near the axis. The narrow diameter also helps to minimize the necessary RF voltage, so that direct transistor supply or small, simple ferrite core transformers can be used to deliver RF voltages up to several hundred volts and frequencies up to several megahertz. Simple control of voltage and frequency is thus made possible, enabling the operator to select the lower cut-off limit for the mass-to-charge ratio. While the ring structure needs a DC field as described above, a double helix structure may also be used. The double helix works, in principle, without a DC field since there are no shallow wells along the axis.

In contrast to the ring structure, there is no undulation of the pseudo potential along the axis of this double helix structure. It is thus favorably suited as a guidance field. In contrast to first impression, the double helix does not form an electric choke (which would otherwise hinder the fast penetration of the RF) if both phases of the RF are supplied at the same end of the cylindrical structure. The resulting magnetic field then disappears since both electric current components, flowing to fill the capacitance of the double helix, each form a magnetic field of opposite polarity.

The shape of the pseudo potential well across the cylinder can be changed easily by changing the slope of the wire, i.e., the distance between neighboring wire windings. A wide slope results in a pseudo potential well roughly similar to that of a quadrupole rod device, whereas narrower slopes result in wells roughly proportional to $r^4$ or $r^6$. These wells correspond to wells of hexapole or octopole rod arrangements. The double helix thus has the advantage of being continuously adaptable to desired forms of the pseudo potential well. This is important considering that the shape of the pseudo potential well has large influence on the kind of storage of ions inside the well: an $r^2$- potential collects ions near the axis, whereas an $r^6$- potential gathers the ions near the cylinder wall, because the slightest space charge drives the ions to the outside within the flat bottom of the pseudo potential well.

The double helix device is easy to produce and forms a rigid and robust structure. With the help of a two-threaded screw, easily made on a lathe to exact specifications, the two wires of a double helix can be wound into the threads of the screw. If the wire is hard and elastic, it is favorable to wind it first onto a core of smaller diameter, and to stretch the resulting helical structure to make it fit. A double helix with 4 millimeter inner diameter can be made of 0.6 millimeter stainless steel (or another chromium-nickel-alloy) with 1 millimeter distance between neighboring wires, making a total pitch of turns of 3.2 millimeter per wire.

Figure 10A:
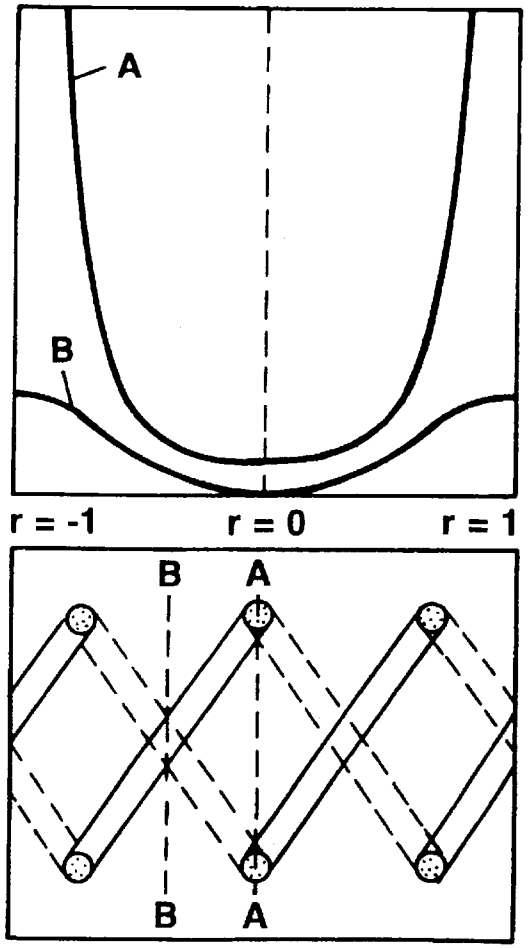
FIGS. 10A–10C are graphical representations of the pseudo potentials wells in double helices of different slopes.
Figure 10B:
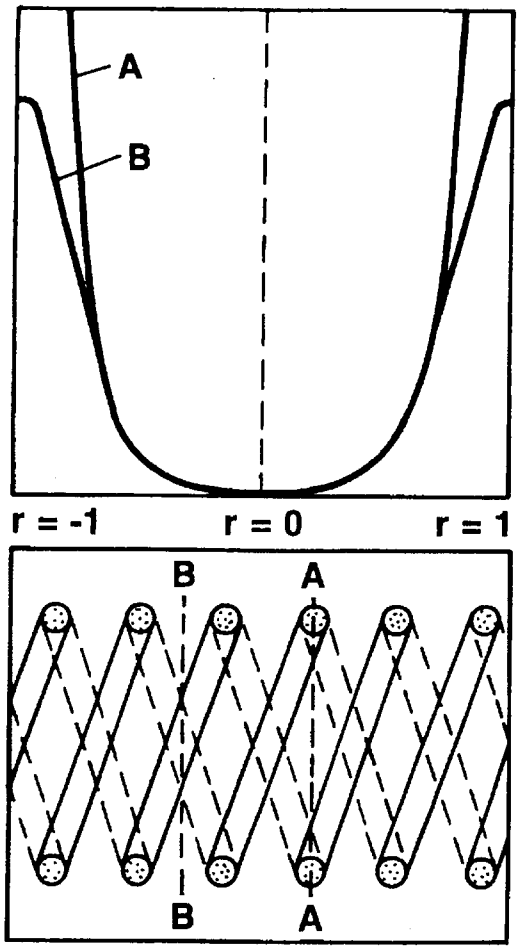
Figure 10C:
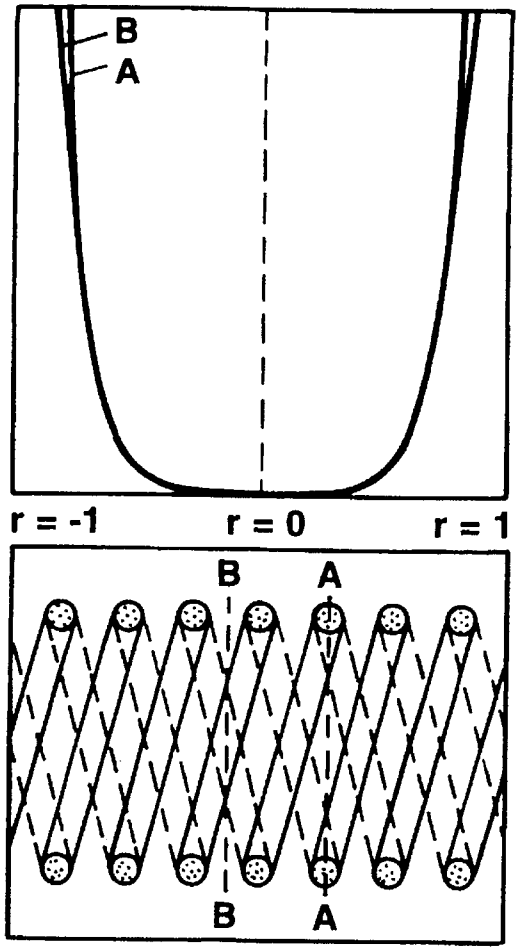

The pseudo potential well of a device having the above dimensions has a characteristic as shown in FIG. 10B. In this figure, the potential well distributions are shown adjacent to a cross-sectional schematic depiction of the double helix coil. The distribution marked "A" is that which exists along line "A—A". The distribution marked "B" is that which exists along line "B—B". If the wires are wrapped with a greater pitch, the distribution will have the characteristic shown in FIG. 10A. If the wires are wrapped with a narrower pitch, the resulting potential well distribution will be shown in FIG. 10C. The pseudo potential wells of the helices are shown for distance-to-radius ratios equal to 1.5 (FIG. 10A), 0.8 (FIG. 10B) and 0.6 (FIG. 10C).

Figure 11A:
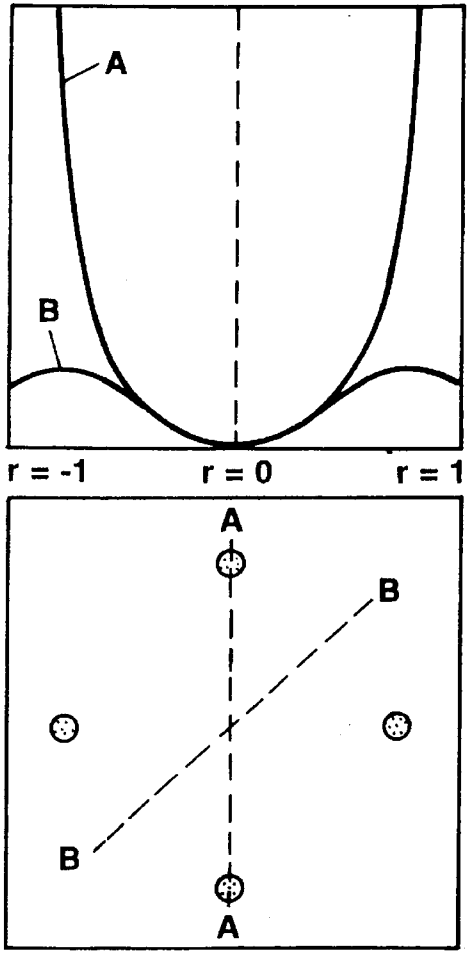
FIGS. 11A–11C are graphical representation of pseudo potentials in prior art multipole rod systems.
Figure 11B:
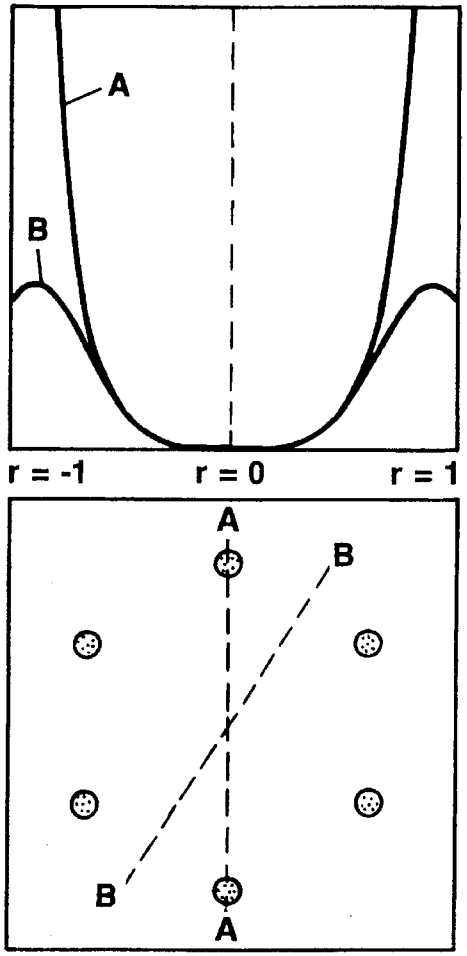
Figure 11C:
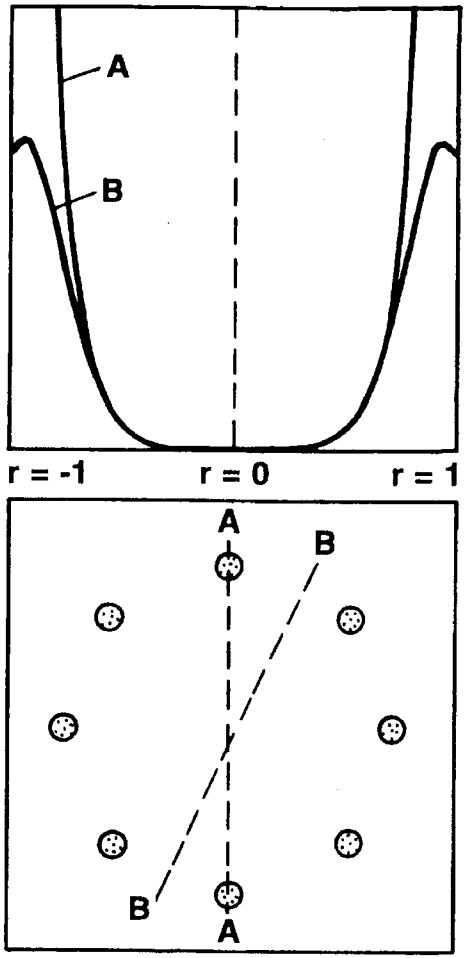

To provide a comparison with prior art multipole rod embodiments, FIGS. 11A–11C depict the potential well distributions for quadrupole, hexapole and octopole arrangements of these multipole rod structures, respectively. As with the FIGS. 10A–10C; the distibutions marked "A" correspond to the line "A—A" of their respective figure, and the lines "B" correspond to the line "B—B" of their respective figure. The distributions are shown adjacent to a cross-sectional schematic depiction of the multipole rod arrangement.

Figure 8:
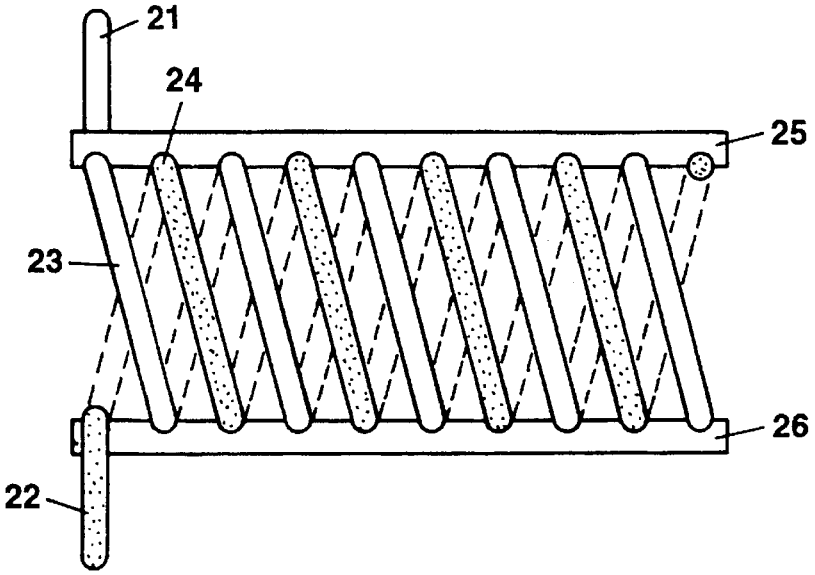
FIG. 8 is a partial side view of the double helix consisting of the two wire coils.

Referring to FIG. 8, wire windings 23 and 24 are mounted on a screw. While on the screw, the windings are glued into milled grooves (of correct pitch and diameter) of thin holders 25 and 26 made from ceramic, glass or a suitable plastic. Two, three, or even four such holders may be used, each about 1 millimeter thick. After hardening of the glue, the screw can be removed, and the robust structure of the double helix with holders remains. The hard wire, bent to small circles and fastened at short distances, forms a rigid device which cannot easily be deformed or destroyed. It is highly resistive against vibrations and shock.

An RF voltage adjustable between 40 and 600 Volts, with a frequency adjustable between 2 and 6 Megahertz, is fed to the wire ends 21 and 22. Lower cut-off masses between 10 and 1000 atomic mass units for singly charges ions can be selected within these RF voltage and frequency ranges. The cut-off mass is proportional to the voltage, and inversely proportional to the square of the frequency. The exact cut-off mass depends on the mechanical parameters of the double helix and has to be calibrated.

Superposition of the RF voltage with a DC voltage ejects ions with high masses from the double helix device. With a correctly produced double helix of high precision, it is possible to filter ions of a single mass-to-charge ratio, that is, only those ions will remain within the double helix. The double helix therefore may be used to build inexpensive mass spectrometers. When using the double helix as an ion guide, however, it is particularly useful for filtering a moderately wide range of ion masses, keeping the precision tolerances moderate. The final isolation of a single kind of ions can be performed more easily within the subsequent mass spectrometer.

As in the case of the multiple ring system of FIGS. 5–7, an axial DC field can also be superimposed on the double helix. The axial DC field may be used to accelerate the emptying the structure of ions caught in the shallow potential wells. If resistance wires are used, a DC current through both wires generates this field. Again, the flow of any RF current into the DC power supply can be hindered by RF chokes. A low field of 0.1 Volts per centimeter provides a DC field which causes most ions to exit the double helix.

An alternative embodiment of the invention is arranged to improve the emptying process of the double helix. In this embodiment, the double helix is wound onto a conical core, the conicity giving a permanent drive to the side of the larger diameter. This drive provided by the conical shape operates on particles of both polarities. If ions are stored at the wider end of the cone, they can be easily extracted from that end. The disadvantage of this "ion-emptying" drive structure, is that it can not be switched on and off, as with the DC field. Typical dimensions of such a cone are a 3 mm inner diameter at the entrance, and a 6 mm inner diameter at the exit. The ions get a continuous drive towards the end, and the ion cloud gathers near the exit. Such an ion guide can be emptied much faster than the cylindrical double helix. This allows for fast filling of any type of ion trap.

Figure 9:
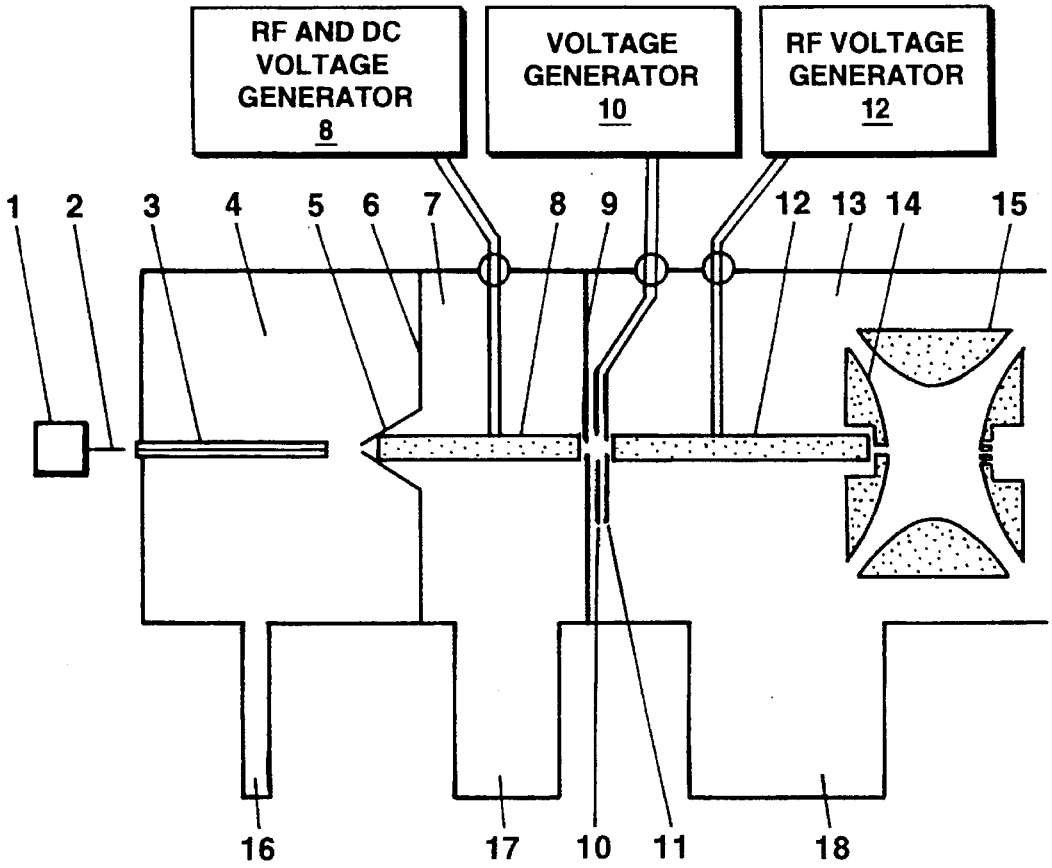
FIG. 9 is a schematic representation of an application using two ion guides according to the present invention.

A preferred application of the double helix ion guide as used with a mass spectrometer is now described with reference to FIG. 9. Two double helices are used in this application, each with a slightly different purpose. This embodiment uses, as a mass spectrometer, an RF quadrupole ion trap with end caps 14 and ring electrode 15. Ions are generated by an electrospray ion source, and the ions are fed to an evacuated pumping chamber 4 via an entrance capillary 3. The two ion guides serve for thermalization of the ions, for temporary storage, for filtering, and for guidance. An RF quadrupole ion trap consists of two end cap electrodes 14 and a ring electrode 15. The ion trap is filled with external ions through a small hole in one of the end caps 14, and is filled with ions during a filling period only. The filling period is repeated periodically, being followed each time by an investigation period. The investigation period consists of any subperiods, like ion damping, ion isolation, ion fragmentation, spectrum measurement, trap clearing, and so on. These subperiods are of no direct interest here, except that it is noted that during these periods, no ions are allowed to enter the ion trap. The filling process is strictly limited to the filling period, which should be kept, for a high duty cycle of the ion trap mass spectrometer, as short as possible.

Most ion sources, including electrospray ion sources, operate continuously. This is due to a critical balance of parameters which does not allow for switching them off and on easily in a fast sequence. In addition, their rate of ion production is often limited, and they may fail to fill an ion trap in as short a time period as desired. With the help of the simple and robust devices according to this invention, it is possible to collect ions during the investigation periods. This, correspondingly, shortens the filling periods. As a result, the duty cycle of the ion source may be increased, as well as that of the mass spectrometer. Moreover, ions can be conditioned to best acceptance by the ion trap, their kinetic energies being thermalized, and their mass-to-charge ratios being filtered to the desired ranges.

The electrospray ion source consists of a volume 1 containing a solution of the analyte molecules. The solution will be sprayed off the tip of a spray needle 2 by a spray voltage of roughly 5 kilovolts applied between the needle 2 and a counter electrode at the front end of entrance capillary 3. Ions of the analyte molecules are thus formed. The ions are transported by a strong flow of gas through the fine capillary 3 into the vacuum system of the mass spectrometer. The entrance capillary 3 has an inner diameter of about 0.5 millimeter, and its length is about 100 millimeter. Roughly 2 liters of gas flow per minute into the first differential pumping chamber 4 of the vacuum system. Pumping chamber 4 is pumped to a few millibars by a roughing pump operating through flange 16.

The ions exiting capillary 3, together with the gas, are accelerated in the expanding gas, and are drawn, by a moderate electric field, towards the skimmer 5, being located opposite the entrance capillary. Skimmer 5 is a conical device with a small hole of 1.2 millimeter diameter at the tip. The conical walls reflect the attacking gas molecules to the outside. A fraction of the ions enter, together with a much smaller amount of the gas, through the small skimmer hole into the second chamber 7 of the differential pumping system. Chamber 7 is pumped to about $2\times10^{-3}$ millibar through pumping flange 17.

Just behind the small hole in skimmer 5 is a first end of the first ion guide 8. The ion guide 8 consists of a double helix with a somewhat narrow pitch in order to create a large storage volume for the ions. The ions enter the ion guide, and the accompanying gas molecules escape through the gaps between the windings. A gas pressure of roughly $5\times10^{-3}$ millibar inside the ion guide reduces the ion movements very effectively, and the ions are thermalized within about 1 millisecond. The inner diameter of the ion guide is only 4 millimeter, making the ion guide easy to fit into the skimmer cone, reducing RF voltage requirements.

The ends of both helical coils are connected to the RF voltage supply. Voltage and frequency of the RF voltage are selected to give a desired lower the mass-to-charge ratio cutoff for the ions. Ions with lower mass are not stored in the double helix. In this way, ions of low mass (e.g. ions of the solvent, or of low molecular weight contaminants in the solvent) are eliminated.

With a frequency of about 6 megahertz, and a voltage of about 250 volts, singly charged ions above 50 atomic mass units are stored within the double helix. Lighter ions (e.g. $N_2^+$, $O_2^+$, or $CO_2^+$) leave the ion guide. An application of higher voltages, or lower frequencies, increases the cut-off limit up to about 1000 atomic mass units. The precise dependence of the cut-off limit on voltage and frequency is preferably determined experimentally by a calibration procedure.

By optional superposition of the RF voltage with a DC voltage, the mass range will be additionally restricted at the high mass side. Under favorable conditions, the range of filtered masses can be limited to exactly one atomic mass unit. In this manner, ions will be preselected before they are further transported to the mass spectrometer. Here, too, a calibration procedure determines the exact parameters necessary to filter ions in a desired range of masses.

Experiments show that practically all ions penetrating the small hole in skimmer 5, are caught by double helix 8 if the ion's mass is above the cut-off mass. This exceptionally good yield is achieved by the gas dynamic guidance of the ions at the front end of ion guide 8. Chamber 7 is pumped through flange 17 down to a pressure of several thousandths of a millibar.

The double helix 8 ion guide extends from the hole in skimmer 5 across chamber 7 to a small hole in wall 9. By adjustment of the mean RF potential of the double helix with respect to the potentials of skimmer 5 and wall 9, the double helix can be used to store ions of one polarity. Depending on whether the mean RF potential is held negative or positive, either positive or negative ions can be stored. The stored ions are reflected at both ends by the potential difference.

Due to the adiabatic expansion of the gas at the exit of capillary 3, the ions enter the double helix 8 with a speed of about 500 to 1000 meters per second, independent of mass. However, the ions will be thermalized quickly by frequent collisions with the residual gas molecules inside the double helix. Depending on the residual gas pressure, the thermalizing process takes between a few tenths of a millisecond and a few milliseconds. Because of the structure of the double helix, thermalization of radial and axial movements need about the same time.

Thermalized ions normally gather about the axis of the ion guide. Due to the flat bottom of the pseudo potential wells, space charge with corresponding Coulomb repulsion forces will soon increase the ion cloud, and the ions will cover a wider range up to the steeper part of the pseudo potential well. The hole in wall 9, and apertures 10 and 11 make up a lens system. By switching the potential at center aperture 10 of the lens, the ions either can be stored in ion guide 8, or transferred into the ion trap.

If a suitable drawing voltage is switched on at the center lens aperture 10, the potential penetrates through the hole in wall 9 into the ion guide 8 and attracts thermalized ions which then are focused through the lens into the second double helix ion guide 12. The flow of ions into the second ion guide 12 will be essentially supported by space charge forces in ion guide 8. The second ion guide 12 transports the ions to the ion trap mass spectrometer, where the ions enter the ion trap through a small hole of 1.5 millimeter diameter in end cap electrode 14. To focus the ions through the small end cap hole, the double helix 12 has a wider pitch so that ions are more easily kept near the axis. The wider pitch creates a narrower pseudo potential well. Notably, the second ion guide 12 need not necessarily be a double helix. Other kinds of ion guides can be used here, e.g. the well-known ion guide consisting of an outer cylinder and inner wire, or an RF multipole rod system.

The ion source may be coupled with substance separation systems, for instance capillary electrophoreses. Capillary electrophoresis delivers substance peaks of extremely short time periods, with high concentrations of substance in the peak. The storage of ions in double helix 8 may be used to temporarily store all the ions from such a substance peak, and to investigate these ions in several subsequent filling and investigation periods, the total duration of which may be much longer than the time period of the substance peak from the electrophoresis. Multiple investigations of the substance will become possible, including complex MS/MS investigations of the main substance masses. Even MS/MS/MS investigations with acquisition of granddaughter spectra will become possible from separated substances. Further substance separation and delivery by the electrophoresis process can be stopped during these investigations by switching off the electrophoresis voltage without essentially damaging the substance resolution.

The ion trap 14, 15 is operated inside vacuum chamber 13, which is pumped through flange 18. The ion trap 14, 15 need not be used as a mass spectrometer. It can also be used to collect ions to be investigated by another type of mass spectrometer, e.g. a time-of-flight mass spectrometer. The ion trap thus may only serve to collect and to concentrate ions which will then be pushed out into the drift tube of a time-of-flight mass spectrometer. Desired ions may be isolated first inside the ion trap. Possibly even the fragmentation process may occur within the ion trap before analysis in the time-of-flight spectrometer, obtaining MS/MS spectra. Time-of-flight mass spectrometers have the advantage of high mass range, good mass resolution, and fast spectrum acquisition. The transfer of ions to ion cyclotron resonance (ICR) mass spectrometers is also possible with ion guides according to this invention. ICR spectrometers operate with similar filling and investigation periods as RF quadrupole ion traps and, thus, the storage capability of the ion guides can greatly increase the duty cycle. Thermalization of ions is even more important here than with RF ion traps. The ion guide normally does not reach directly up the ICR cell, and the strong magnetic field takes over a part of the ion guidance.

In an additional embodiment, the double helix 8 is used to collect all ions above a certain cut-off limit, and double helix 12 is used for further mass-to-charge ratio preselection. This kind of operation is particularly interesting if ions of an electrophoresis substance peak are stored in helix 8, and different kinds of ions are to be transferred to the ion trap in subsequent mass spectroscopic investigations. In a first primary spectrum acquisition, all kinds of ions may be detected and measured and, in subsequent phases, daughter spectra of all those primary ions may be acquired.

Ion sources which are located inside the vacuum system may also be connected to the mass spectrometer via ion guides according to this invention. There are many advantages of such a design, among them the advantage that ion peaks from separation devices may be temporarily stored, or that ions may be prefiltered. The advantage of ion guides according to this invention is not restricted to ion trap mass spectrometers. Other types of mass spectrometers, e.g. quadrupole mass filters, or magnetic sector field mass spectrometers, can benefit from the use of these ion guides. Specifically the thermalization, but also the sheer transfer of ions, provided by the ion guides of the present invention can have positive effects on these mass spectrometers.

The invention is also not restricted to the production of ion guides. Many types of enclosures for ions can be designed with this invention. Ions may be embottled in such devices for many purposes, e.g. optical experiments or reaction experiments, such as catalytic reactions in moderate vacuum. Such bottles may be easily produced, for instance, by two conical double helices put together with their wide ends facing each other. Furthermore, the invention can be used to build large-area gating grids for ions of both polarities.

While the invention has been shown and described with reference to a preferred embodiment thereof, it will be understood by those skilled in the art that various changes in form and detail may be made herein without departing from the spirit and scope of the invention as defined by the appended claims.

What is claimed is:

1. An ion reflection surface for reflecting charged particles of both positive and negative polarities, the surface comprising:

a plurality of electrically conducting grid elements spaced in a substantially regular manner in at least a first direction along the surface;

a first high-frequency electrical signal supplied to alternating grid elements along the first direction; and a second high-frequency electrical signal supplied to alternating grid elements interspersed between the grid elements which are supplied with the first signal, the second electrical signal having the same frequency as the first electrical signal at a different relative phase.

2. An ion reflection surface according to claim 1 wherein the second electrical signal has a phase substantially opposite to that of the first electrical signal.

3. An ion reflection surface according to claim 1 further comprising a DC electrical signal which is superimposed on at least one of the high-frequency signals.

4. An ion reflection surface according to claim 3 further comprising an additional DC signal which is supplied to at least one of the grid elements such as to establish an electric field component along the first direction.

5. An ion reflection surface according to claim 1 wherein the grid elements are metal wire tips oriented perpendicularly to the reflection surface.

6. An ion reflection surface according to claim 1 wherein the high-frequency signals are radio frequency (RF) signals.

7. An ion reflection surface according to claim 1 wherein the alternating grid elements supplied with the first high-frequency signal comprise a metal mesh and the alternating grid elements supplied with the second high-frequency signal comprise isolated metal tips within cells formed by the mesh.

8. An ion reflection surface according to claim 7 wherein at least one of the high-frequency signals is superimposed by a DC electrical signal.

9. An ion reflection surface according to claim 8 further comprising an additional DC signal which is supplied to at least one of the grid elements such as to establish an electric field component along the first direction.

10. An ion reflection surface according to claim 1 wherein the grid elements are metal wires.

11. An ion reflection surface according to claim 1 wherein the grid elements comprise windings of two metal wires wound to a double helix, the first wire being supplied with the first electrical signal and the second wire being supplied with the second electrical signal.

12. An ion reflection surface according to claim 11 where the diameter and pitch of the double helix are selected to provide a predetermined potential distribution within the helix.

13. An ion reflection surface according to claim 11 further comprising a DC electrical signal supplied to at least one of the wires such that a DC field is generated along the cylinder axis which influences the injected ions.

14. An ion reflection surface according to claim 13 wherein the DC field is such that it influences the ions so as to filter charged particles within a predetermined range of mass-to-charge ratios.

15. An ion reflection surface according to claim 11 further comprising reflecting electric DC potentials of identical sign applied to both ends of the double helix so as to store ions within the double helix by reflection from the inner reflective surface and from the electric DC potentials at the ends of the double helix.

16. An ion relfection surface according to claim 15 wherein at least one of the electric DC potentials is switchable.

17. An ion reflection surface according to claim 11 further comprising a vacuum source which maintains a vacuum pressure within the double helix in the range of $10^{-4}$ to $10^{-2}$ millibar so as to thermalize kinetic energies of ions by collisions with gas molecules.

18. An ion reflection surface according to claim 1 wherein the reflection surface is an inner side of a cylindrical structure.

19. An ion reflection surface according to claim 18 wherein the ion reflection surface comprises an ion guide for guiding ions within the cylindrical structure in a general direction corresponding to an axis of the cylindrical structue.

20. An ion reflection surface according to claim 19 wherein at least one of the high-frequency signals is superimposed by a DC electrical signal.

21. An ion reflection surface according to claim 20 further comprising an additional DC signal which is supplied to at least one of the grid elements such as to establish an electric field component along the first direction.

22. An ion reflection surface according to claim 19 wherein the grid elements are metal wires.

23. An ion reflection surface according to claim 22 wherein the metal wires are rings around an axis of the cylindrical structure.

24. An ion reflection surface according to claim 23 wherein at least one DC voltage is applied to the at least one of the rings such as to create a DC electric field component along said axis.

25. An ion reflection surface according to claim 18 wherein the grid elements comprise windings of at least one pair of conductors wound helically around an axis of the cylindrical structure.

26. An ion reflection surface according to claim 1 wherein the first high-frequency electrical signal and the second high-frequency electrical signal originate from one electrical signal source.

27. A method of reflecting charged particles of both positive and negative polarities, the method comprising:

forming a reflective surface of electrically conductive grid elements spaced in a substantially regular manner in at least a first direction along the surface;

supplying alternating grid elements along the first direction with a first high-frequency electrical signal; and supplying alternating grid elements interspersed between those grid elements which are supplied with the first electrical signal with a second high-frequency electrical signal having the same frequency as the first electrical signal at a different relative phase.

28. A method according to claim 27 wherein supplying the second electrical signal comprises supplying the second electrical signal such that it has a phase which is substantially opposite to the phase of the first electrical signal.

29. A method according to claim 27 further comprising supplying a DC electrical signal which is superimposed on at least one of the high-frequency electrical signals.

30. A method according to claim 29 further comprising supplying an additional DC signal to at least one of the grid elements such as to establish an electric field component along the first direction.

31. A method according to claim 27 wherein forming a reflective surface of electrically conductive grid elements comprises providing metal wire tips oriented perpendicularly to the reflection surface.

32. A method according to claim 27 wherein forming a reflective surface of electrically conductive grid elements comprises forming the surface in a substantially cylindrical shape.

33. A method according to claim 32 wherein the method further comprises guiding ions with the surface by injecting ions into the cylindrical surface such that the ions are reflected within the surface as they travel in a generally axial direction within a space defined by the surface.

34. A method according to claim 27 wherein forming a reflective surface of electrically conductive grid elements comprises forming a reflective surface in which the grid elements comprise windings of two metal wires wound to a double helix, the first wire being supplied with the first electrical signal and the second wire being supplied with the second electrical signal.

35. A method according to claim 34 further comprising guiding ions within the double helix by injecting ions into an entrance at one end of the cylindrical double helix and reflecting the ions from an inner surface of the double helix as they travel to an exit at the other end of the double helix.

36. A method according to claim 35 further comprising supplying a DC current to at least one of the wires such that a DC field is generated along the cylinder axis which influences the injected ions.

37. A method according to claim 36 further comprising influencing the injected ions with the DC field in such a way that a filter for ions within a predetermined range of mass-to-charge ratios is created.

38. A method according to claim 35 wherein reflecting electric DC potentials of identical sign are applied to both ends of the double helix to store ions inside the double helix by reflection on the inner surface and on the electric DC potentials at the ends of the double helix.

39. A method according to claim 38 wherein at least one of the reflecting DC potentials is switchable.

40. A method according to claim 39 further comprising operating the double helix and the reflecting DC potentials so as to temporarily store substance ions of a substance peak coming out of a chromatographic or electrophoretic separation device.

41. A method according to claim 35 further comprising maintaining a vacuum pressure in the range of $10^{-4}$ to $10^{-2}$ millibar within the double helix such as to thermalize kinetic energies of ions by collisions with gas molecules.

42. A method according to claim 35 further comprising guiding ions with the double helix into an ion trap.

* * * * *